US006767254B1

(12) United States Patent
Chen

(10) Patent No.: US 6,767,254 B1
(45) Date of Patent: Jul. 27, 2004

(54) FOLDABLE EXPANSION DIGITAL STRUCTURE

(76) Inventor: Chien-Yuan Chen, Fl. 5-1, No. 8, Sec. 3, Shuang-Shi Rd., Banchiau City, Taipei County (TW)

( * ) Notice: Subject to any disclaimer, the term of this patent is extended or adjusted under 35 U.S.C. 154(b) by 0 days.

(21) Appl. No.: 10/366,314

(22) Filed: Feb. 14, 2003

(51) Int. Cl.[7] ..... H01R 28/00
(52) U.S. Cl. ..... 439/640; 439/31
(58) Field of Search ..... 439/929, 31, 9, 439/11, 13, 29, 30, 640, 1, 12, 18, 23, 24, 25, 26, 27, 28

(56) References Cited

U.S. PATENT DOCUMENTS 4,715,819 A * 12/1987 Iwasa et al. ..... 439/31
4,850,882 A * 7/1989 Yu ..... 439/31
4,863,388 A * 9/1989 Reimer et al. ..... 439/31
4,865,553 A * 9/1989 Tanigawa et al. ..... 439/31
5,732,331 A * 3/1998 Harms ..... 455/575.3

* cited by examiner

*Primary Examiner*—Ross Gushi

(57) ABSTRACT

A foldable expansion digital structure includes a digital card body and a periphery for a computer. The digital card body provides a conducting plate at a lateral side thereof and a support shaft at another lateral side thereof. The support shaft has a plurality of connecting pins to be joined to the conducting plate and has a projecting spot at two ends thereof respectively. The periphery provides a shaft groove at the bottom thereof corresponding to the support shaft. The shaft groove at two lateral sides thereof has a locating recess respectively for fitting with the projecting spot. A plurality of spring strips are provided on the shaft groove as terminals for keep contact with the connecting pins. Hence, the periphery can be rotated a suitable angle with respect to the support shaft.

1 Claim, 3 Drawing Sheets

FOLDABLE EXPANSION DIGITAL STRUCTURE

BACKGROUND OF THE INVENTION

1. Field of the Invention

The present invention is related to foldable expansion digital structure and particularly to an expansion card capable of a computer connecting with a periphery thereof easily.

2. Brief Description of Related Art

Currently, the digital card has been broadly used in the field of computer application such as data storage and connecting with peripheries. The expansion card available on market is integrally made with the peripheries for signal transmission between the peripheries and the computer.

The above-mentioned conventional foldable expansion digital structure provides the periphery a unchangeable position relative to the expansion card such that it is not possible for the user to adjust the position of the periphery for aligning with the computer in case of the expansion card being connected to the computer and the periphery is not properly disposed with respect to the computer. Hence, if there is no sufficient space available, it is very inconvenient for the user to find a room for the periphery. Further, due to the traditional foldable expansion digital structure providing the digital card being integrally made with the periphery, it results in an increase of cost. For instance, if a digital camera and a MP3 are going to be bought and prices of the digital camera and the MP3 for connecting with the computer have to be included additionally.

SUMMARY OF THE INVENTION

A main object of the present invention is to provide a foldable expansion digital structure, which includes a digital card body and computer periphery. The digital card body is connected to the periphery such as digital camera, digital video camera, GPKS, MP3 or communication equipment with a support shaft on the digital card body. The periphery can be rotated a proper angle with respect to the digital card body in a narrow space so that the signals can be transmitted between the periphery and the computer. Further, the periphery is detachably connected to the digital card so that it is quite easy for replacing the periphery.

BRIEFED DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENT

Figure 1:
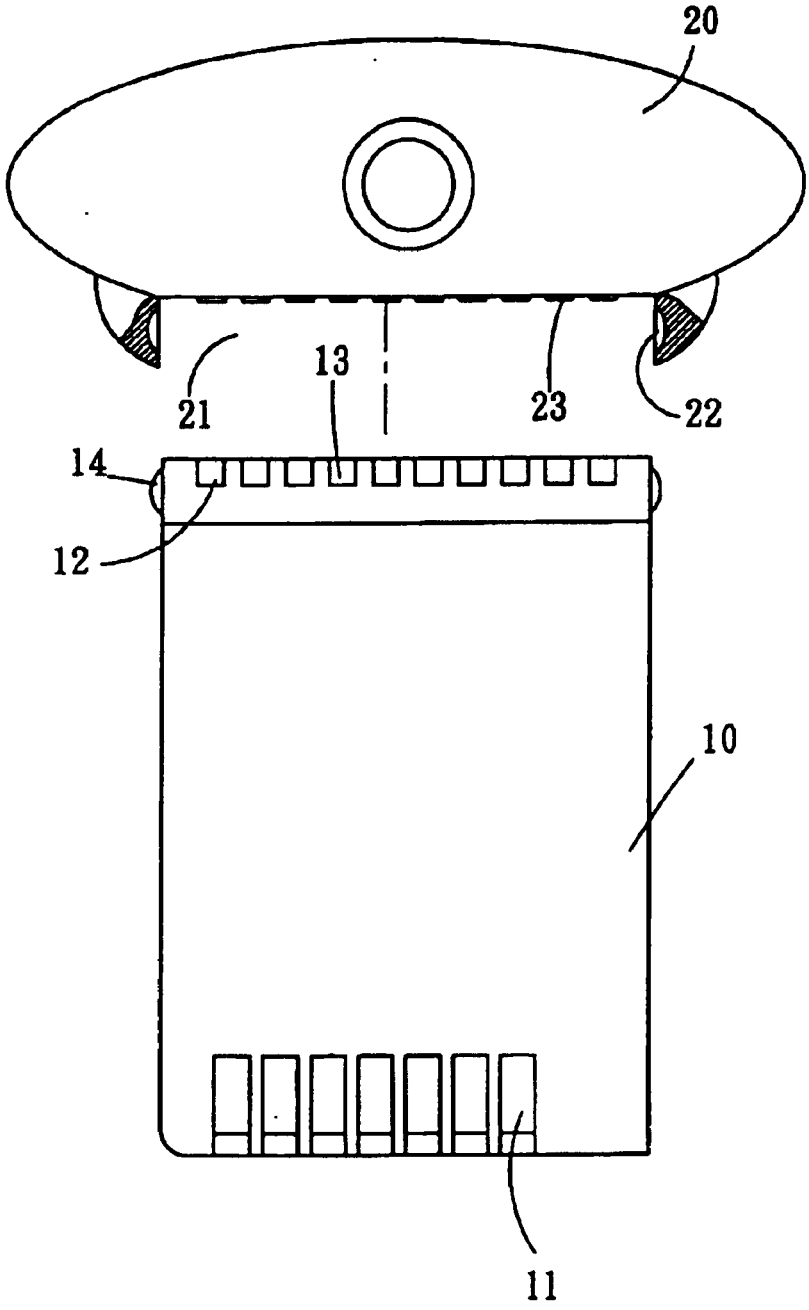
FIG. 1 is an exploded diagrammatic view of the present invention.

Referring to FIG. 1, a foldable expansion digital structure according to the present invention consists of a digital card body 10 and a p riphery 20 for a computer.

The digital card body 10 at a lateral side thereof has a conducting plate 11 for being coupled to the computer after being inserted into an expansion groove and at another lateral side thereof has a support shaft 12. The support shaft 12 is provided with a plurality of connecting pins 13 for contact with the conducting plate 11. The support shaft 11 has at two ends thereof a projecting spot 14 respectively.

The periphery 20 such as digital camera, digital video camera, GPKS, GPS, MP3 or communication equipment has a shaft groove 21 at the bottom thereof corresponding to the support shaft 12. The shaft groove 21 has at two lateral sides thereof a locating recess respectively for fitting with the projecting spots 14. The shaft groove 21 is provided with a plurality of spring strips 23 as terminals for keeping contact with connecting pins 13 while signal is transmitted between the periphery and the computer.

When the digital card body 10 is assembled to the periphery 20, the support shaft 12 is inserted into the shaft groove 21 to allow the projecting spots 14 fitting with the locating recesses 22 and the spring strips 23 keep pressing against the connecting pins 13.

Figure 2:
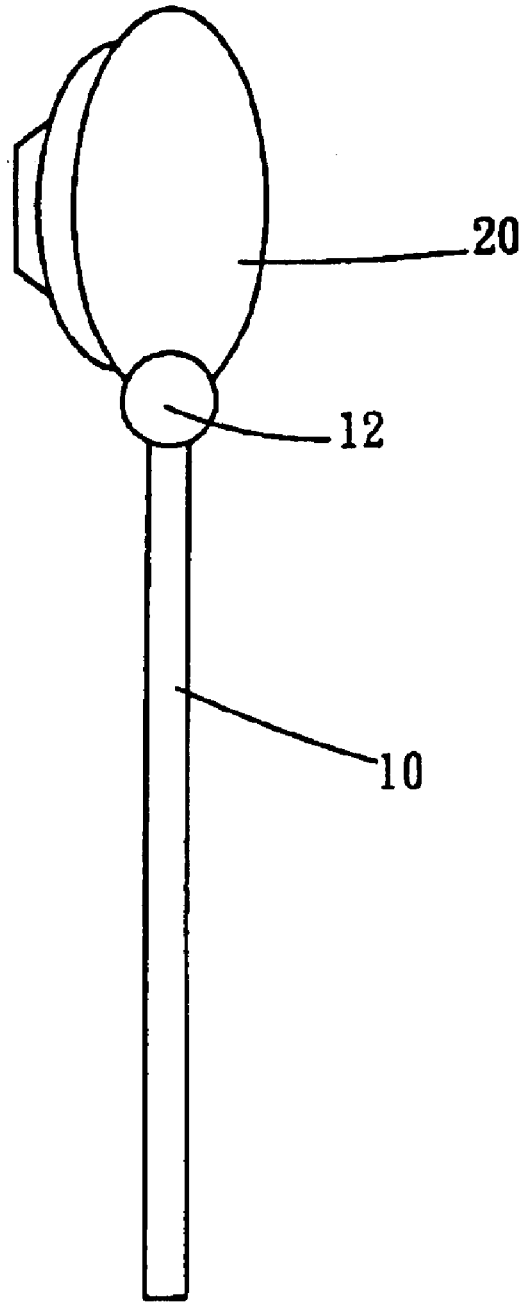
FIG. 2 is a side view of the present invention.
Figure 3:
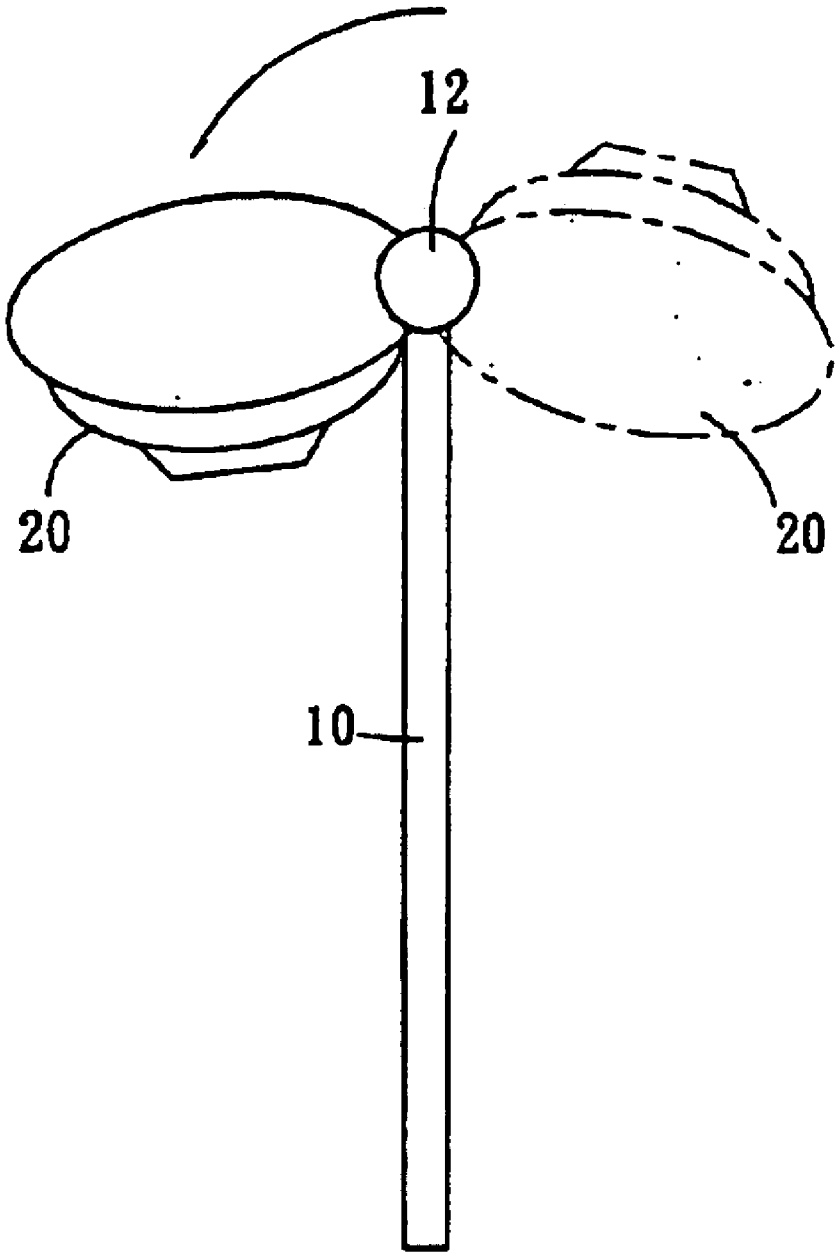
FIG. 3 is another side view of the present invention.

Referring to FIGS. 2 and 3, the periphery 20 can be rotated angularly with respect to the support shaft 12 and the maximum angular displacement can be reached to 270°. Because the spring strips 23 keep contact with the connecting pins 13 during rotating, it is not possible to occur a problem of incomplete contact. The feature of angular adjustment makes the periphery 20 possible to be adjusted according to the available space while the digital card body 10 is connected to the computer so that the periphery 20 is unable to interfere with other peripheries, which have been associated with the computer.

In addition, both the periphery and the digital card of the present invention are detachably joined together so that it is only necessary for the user to buy a single digital card body 20 with a required periphery providing the same interface size as the digital card. In this way, it is advantageous that the digital card can be suitable for different peripheries with facility and the cost thereof is lowered tremendously.

It is appreciated that the foldable expansion digital structure according the present invention provides a simple and special structure to make the periphery possible being rotated to a suitable angle with respect to the support shaft relative to the digital card body and to allow the periphery being able to be used in a narrow space conveniently. Further, the periphery can be detachably joined to the digital card body so that it can be replaced easily.

While the invention has been described with referencing to a preferred embodiment thereof, it is to be understood that modifications or variations may be easily made without departing from the spirit of this invention, which is defined by the appended claims.

What is claimed is:

1. A foldable expansion digital structure, comprising:

a digital card body, providing a conducting plate at a lateral side thereof and a support shaft at another lateral side thereof and the support shaft having a plurality of connecting pins to be joined to the conducting plate and having a projecting spot at two ends thereof respectively; and a periphery for a computer, providing a shaft groove at the bottom thereof corresponding to the support shaft, the shaft groove at two lateral sides thereof having a locating recess respectively for fitting with the projecting spot and a plurality of spring strips being provided on the shaft groove as terminals to press the connecting pins;

whereby, once the support shaft is inserted into the shaft groove to allow the projecting spot fitting with the locating recess and the spring strips are pressed against the connecting pins, the periphery can rotate with respect to the support shaft.

* * * * *